US005422466A

United States Patent [19]

Saitoh et al.

[11] Patent Number: 5,422,466

[45] Date of Patent: Jun. 6, 1995

[54] REVOLUTION INDICATOR FOR MEASURING DISTANCES

[75] Inventors: Masahiro Saitoh, Saitama; Hiroshi Katoh, Tokyo, both of Japan

[73] Assignee: Wako Seiki Kabushiki Kaisha, Wako, Japan

[21] Appl. No.: 215,679

[22] Filed: Mar. 22, 1994

Related U.S. Application Data

[63] Continuation of Ser. No. 917,224, Jul. 23, 1992, abandoned.

[51] Int. Cl.[6] ..... G06M 1/00

[52] U.S. Cl. ..... 235/91 M

[58] Field of Search ..... 235/91 M; 324/207.22, 324/207.21, 207.25, 157; 340/870.02, 870.3

[56] References Cited

U.S. PATENT DOCUMENTS

| | | | |
|---|---|---|---|
| 4,028,530 | 6/1977 | Bud et al. | 235/133 R |
| 4,274,053 | 6/1981 | Ito et al. | 324/207.21 |
| 4,319,188 | 3/1982 | Ito et al. | 324/207.21 |
| 4,660,035 | 4/1987 | Hoffman | 340/870.02 |
| 4,811,368 | 3/1989 | Lee | 340/870.02 |
| 4,851,771 | 7/1989 | Ikeda et al. | 324/207.25 |
| 5,010,334 | 4/1991 | Ponzio | 340/870.02 |

*Primary Examiner*—M. L. Gelluer
*Assistant Examiner*—Eddie C. Lee
*Attorney, Agent, or Firm*—Cushman Darby & Cushman

[57] ABSTRACT

This invention relates to a revolution indicator housed inside a casing. The indicator has a plurality of wheels with the numerals 0–9 on the outer periphery of the wheels. The numerals are viewed through a window from the outside of the casing. Each wheel is also encoded magnetically such that each wheels' rotational position can be determined electronically. The rotational position of each wheel can be displayed electronically at a remote location outside the casing.

14 Claims, 4 Drawing Sheets

REVOLUTION INDICATOR FOR MEASURING DISTANCES

This is a continuation of Application No. 07/917,224, filed on Jul. 23, 1992, which was abandoned upon the filing hereof.

BACKGROUND OF THE INVENTION 1. (a) Field of the Invention

The present invention relates to a revolution indicator which is suitable for use in measuring distances, particularly, for use in measurement of moving distances or positions of movable elements such as a table of a machine tool or the like.

2. (b) Description of the Prior Art

It is well known such a distance-measuring device that it includes a plurality of character-displaying wheels adapted to be rotated by rotational motions which are converted from linear motions of various mechanical elements. Such device is widely utilized at present due to its reliable operation.

On the other hand, the development of the automatic control technique provides a method of controlling the operations of various machines in various producing steps which is widely used nowadays. An encoder for such a purpose and an apparatus for indicating detection values by electronic means are provided.

Although the above electronic indicators are suitable for automatic control of the apparatus, there is a problem such that they don't operate in case of a power failure. When a power failure occurs, the recorded values just before the occurrence of the power failure are lost. In the machine tool or the like, therefore, it is dangerous to rely on only those electronic indicators. In many cases, accordingly, the mechanical revolution indicator is still often used.

On the basis of such circumstances, in JP-U-1-65839, the same inventor as the present inventor has already disclosed an electro-mechanical counter in which a rotary encoder is attached to a mechanical revolution indicator and an output of the encoder is counted by an electronic counter.

The encoder used ill such an apparatus, however, is of the incremental type and its output pulse is counted by the electronic indicator. When a power failure occurs, therefore, the recorded value of the electronic indicator returns to zero and thus differs from the indication value of the mechanical revolution indicator.

Therefore, in the case where such an apparatus is used as an apparatus for indicating the displaced position of a mechanical element from a reference point, it is necessary that such a mechanical element is once returned to the reference point and the recorded value of tile counter is reset and the indicated values of two indicators are made to coincide with each other.

Even when the operation of the machine is restarted after the stop of the operation or when the indication values of the mechanical revolution indicator and of the electronic indicator differ to each other, the adjustment as mentioned above are necessary.

Subject that the Invention is to solve

The present invention was made to solve the above problems and it is an object of the invention to provide a convenient and accurate revolution indicator for measuring distances, wherein an indication value of a mechanical indicator and an indication value of an electronic indicator always coincide and thus, there is no need to be adjusted in any case.

SUMMARY OF THE INVENTION

The above object is accomplished by a revolution indicator for measuring distances comprising:

a plurality of numeral indicating wheels having numeral indicating drums, each outer peripheral surface of which is provided with numerals 0 to 9 positioned at same circumferential intervals so that they can be seen from outside;

a common axis for rotatably supporting said plurality of numeral indicating wheels;

input means for transmitting an input rotation to the numeral indicating wheel of the lowest order;

a plurality of rotation transmitting means, each of which is located between two adjacent numeral indicating wheels so that it reduces a rotation of the lower order numeral indicating wheel into 1/10 and transmits it to the adjacent higher order numeral indicating wheel; and a casing which has a window for allowing numerical values shown by the numeral indicating wheels to be seen through said window and which has therein each of said component elements, characterized in that: each of said numeral indicating wheels is provided with a magnetic code ring on the same axis as said numeral indicating drum, codes Indicative of numeral values 0 to 9 being recorded on said magnetic code ring;

code reading means for reading the magnetic codes recorded on the magnetic code ring is provided within said casing, electronic code indicating means is provided on the outside of the casing, and means for transmitting an output of the code reading means to said electronic code indicating means is further provided, whereby the same numerical value as that of the mechanical indicator is caused to be indicated on the electronic indicator.

It is recommended to use a BCD code as a code to be recorded onto the magnetic code ring.

With the construction as mentioned above, since the BCD code recorded on the magnetic code ring attached to the numeral indicating drum of the revolution indicator is of the absolute type, the code can be directly read and , further, can be directly indicated by the electronic indicator.

Thus, the indication value of the mechanical indicator doesn't differ from the indication value of the electronic indicator. Even when the machine is activated or the power failure is recovered, the present position of the mechanical element to be measured can be instantaneously accurately displayed by both of the mechanical and electronical indicators.

BRIEF DESCRIPTION OF THE DRAWINGS

The details of the invention will be more specifically described in connection with the accompanying drawings in which.

DESCRIPTION OF THE PREFERRED EMBODIMENTS

Figure 1:
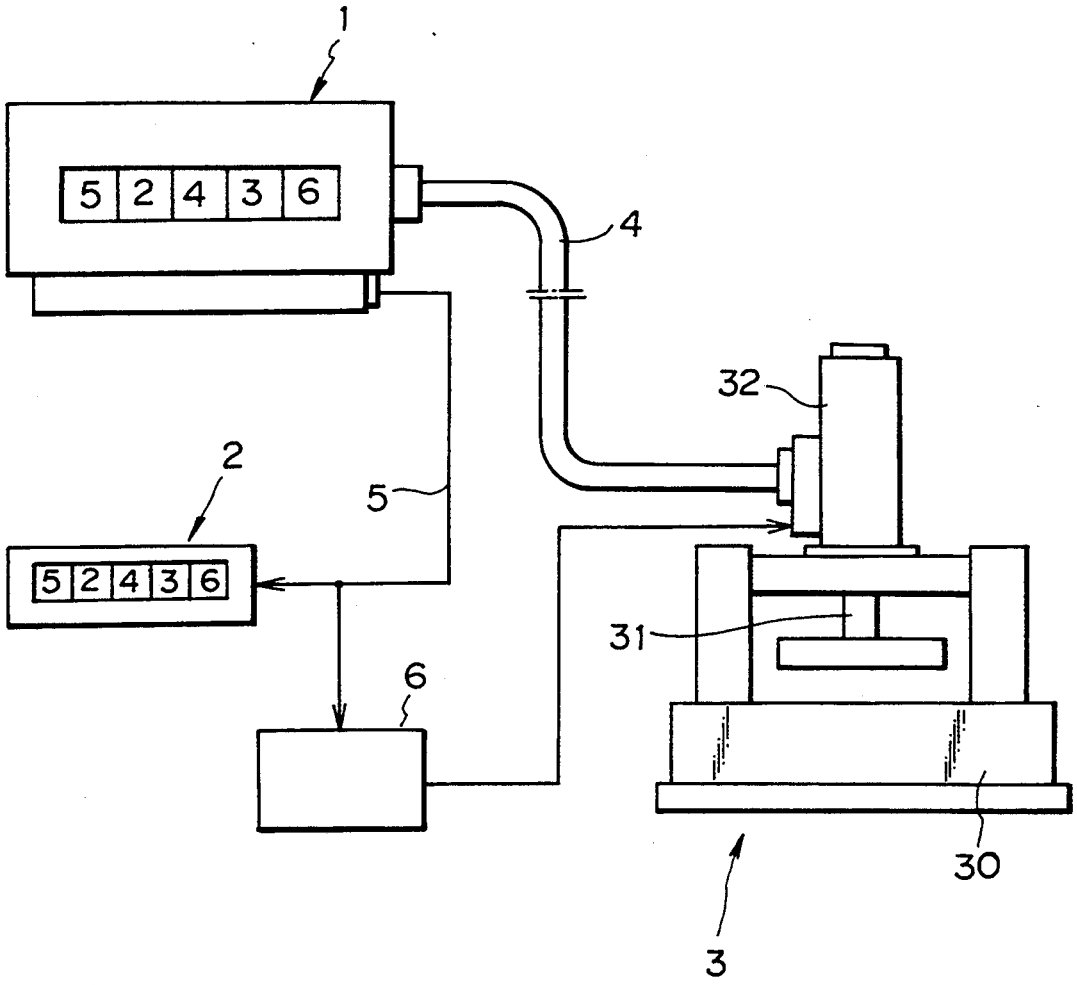
FIG. 1 is a schematic view showing an example in which a revolution indicator according to the present invention is used to measure the position of a ram of a press.

In FIG. 1, reference numeral 1 denotes a mechanical revolution indicator; 2 an electronic indicator; 3 a press; 4 a flexible rotational shaft for transmitting a rotating motion proportional to an elevational motion of the ram of the press to an input shaft of the revolution indicator 1; 5 a cable for leading an output signal of a sensor provided on the revolution indicator 1 to the electronic indicator 2; and 6 an operation control unit of the press 3.

The press 3 has a base 30, a ram 31, and a driving apparatus 32 of the ram 31. A rotational motion proportional to the elevational motion of the ram 31 is taken out of the driving apparatus 32. This rotational motion is transmitted to an input shaft 14 of the mechanical revolution indicator 1 by the flexible rotational shaft 4.

Figure 2:
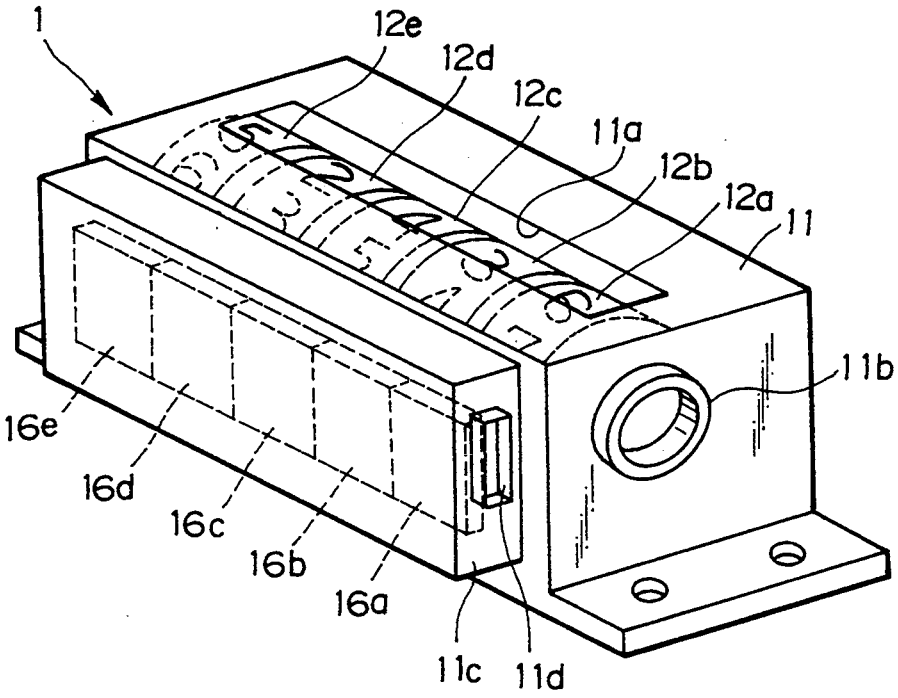
FIG. 2 is an external perspective view showing an embodiment of the revolution indicator according to the present invention.
Figure 3:
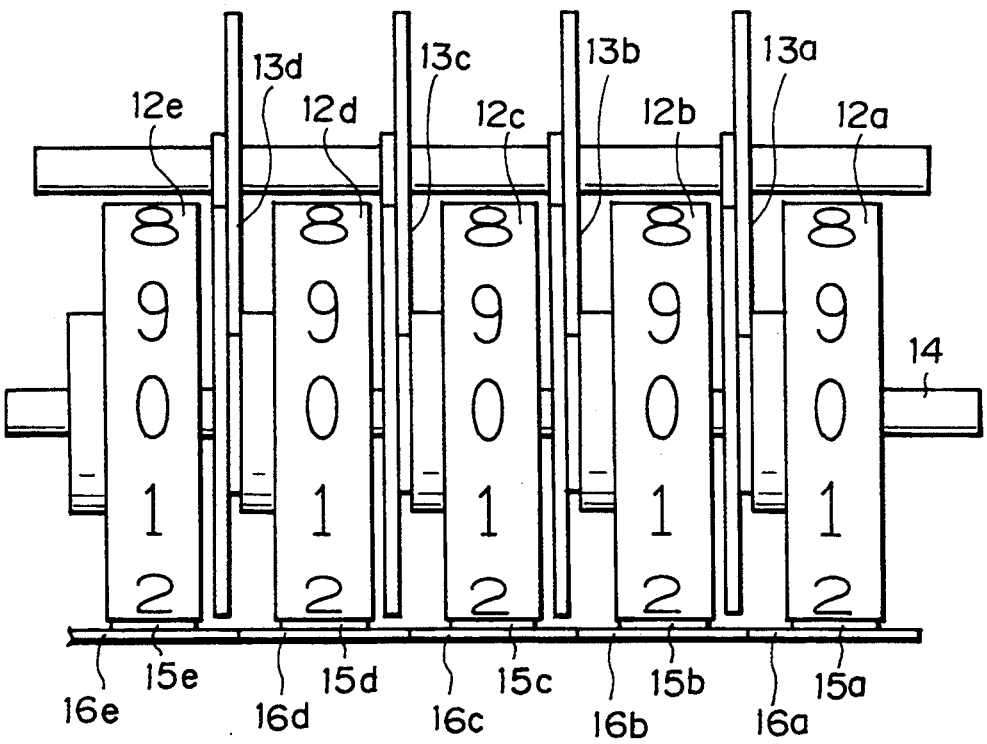
FIG. 3 is a plan view showing an arrangement of magnetic code rings of the revolution indicator arid its magnetic code reading device.
Figure 4:
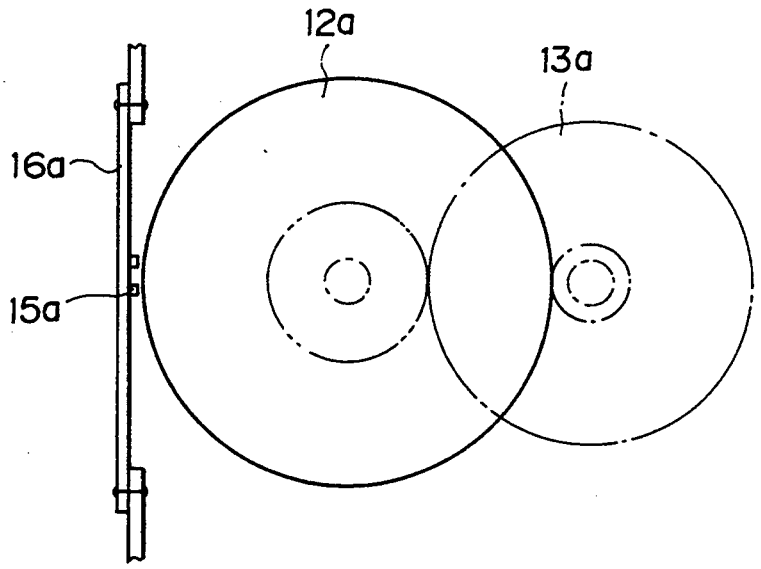
FIG. 4 is an explanatory diagram of the right side of the device of FIG. 3.

A structure of the mechanical revolution indicator 1 is shown in FIG. 2 to 4.

One common axis is provided in a casing 11. Five numeral indicating wheels 12*a*, 12*b*, 12*c*, 12*d*, and 12*e* are mounted on the common axis so as to be rotatable in any of the forward and backward directions.

The numeral indicating wheel 12*a* indicates the lowest digit. The numeral indicating wheel 12*e* indicates the highest digit.

Reduction gear mechanism 13*a*, 13*b*, 13*c*, and 13*d* are provided, each of which is located between two adjacent numeral indicating wheels so as to reduce a rotational amount of the numeral indicating wheel of the lower order(digit) to 1/10 and to transmit it to the adjacent higher order numeral indicating wheel, so that a revolution indicator of five digits is constructed.

According to the reduction gear mechanism, when the lower order numeral indicating wheel makes one rotation and the numeral indicated by the numeral indicating wheel changes from 9 to 0, the higher order numeral indicating wheel that is adjacent to such a numeral indicating wheel is rotated by 1/10 rotation, thereby increasing the indicated numeral of the higher order numeral indicating wheel by only "1".

However, the revolution indicator can rotate in both of the forward and reverse directions. Accordingly, in the mode to reduce the count value upon reverse rotation, when indication numeral of the lower order numeral indicating wheel changes from 0 to 9, the indication value of the adjacent higher order numeral indicating wheel is reduced by only "1".

Figure 5:
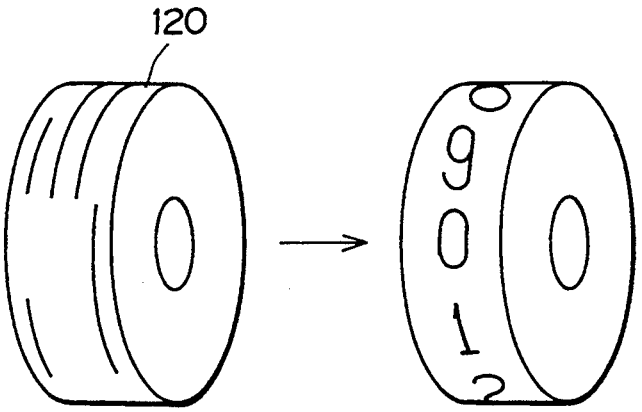
FIG. 5 is an explanatory diagram showing a construction of a numeral indicating wheel.

As is well known, each of these numeral indicating wheels has numeral indicating drum on which numerals 0 to 9 are written. However, in the numeral indicating wheels used in the revolution indicator according to the invention, a magnetic code ring 120 is fitted around the outer periphery of the numeral indicating drum as shown in FIG. 5.

The magnetic code ring 120 is code ring 120 constructed by, for example, providing extremely fine magnetic marks onto the surface of a transparent cylindrical member. Even when such a ring is covered on the surface of the numeral indicating drum of the numeral indicating wheel, no problem occurs when numerals on the numeral indicating drum are read.

Numerical values 0 to 9 are magnetically recorded in the magnetic memory layer 120 by BCD codes (binary coded decimal code) of four bits. A code reading apparatus has four magnetic detecting devices each of which is provided in correspondence to the respective bit of the BCD code of four digits. The code of each bit is read by the corresponding one magnetic detecting device.

On the other hand, the casing 11 is attached with printed circuit boards 16*a*, 16*b*, 16*c*, 16*d*, and 16*e* on which magnetic code reading circuits 15*a*, 15*b*, 15*c*, 15*d*, and 15*e* including four magnetic detecting elements for reading magnetic code on the magnetic code ring are provided.

The casing 11 is formed with a display window 11*a* through which at least one character of the numerical of each numeral indicating drum can be seen by the eyes. Further, there is provided a joint 11*b* for connecting a sheath tube of the flexible rotational shaft 4 to the input shaft 14 of the lowest order numeral indicating drum 12*a*.

A cover 11*c* is attached to attaching portions of the printed circuit boards 16*a* to 16*e* so as to cover them. A connector 11*d* to be connected with the cable 5 is attached to the cover 11*c*, so that outputs of the magnetic code reading circuits 15*a* to 15*e* are taken out of the cable 5.

In one numeral indicating wheel in the mechanical revolution indicator 1, the position facting with the display window 11*a* of the casing 11 and the position facing with the magnetic code reading apparatus are different.

For instance, when the numeral "8" of the numeral indicating drum 12*a* is located at the front position where it can be seen from the window, the position of the magnetic code "8" is located at the position which faces with the magnetic code reading circuit 15, that is, the both positions are shifted 90° to each other.

When the press 3 is operated, a rotation proportional to the elevating motion of the ram 31 is output from the apparatus 32. The rotational motion is transmitted to the input shaft 14 of the revolution indicator 1 through the flexible rotational shaft 4.

In accordance with the rotation of the input shaft 14, the numeral indicating wheels 12*a* to 12*e* are rotated. The numerals which have been written on the surfaces of the outer peripheries of the numeral indicating wheels and can be seen by the eyes are displayed through the display window 11*a* of the casing 11. The BCD codes recorded on the magnetic code rings provided around the outer peripheries of the numeral indicating wheels are read by the magnetic code reading circuits 15*a* to 15*e* and transmitted to the electronic indicator 2 through the cable 5 and displayed.

The indication of the electronic indicator 2 is of the absolute type and corresponds to the BCD code recorded on each magnetic code ring. Thus, the numerical values which can be seen by the eyes from the display window of the revolution indicator 1 and the numerical values displayed by the electronic indicator 2 always coincide.

After the press was stopped by turning off the power source of the press, even when the press is restarted by again turning on the power source, the electronic indicator 2 displays the exact numerical values which are read out by the absolute method. Therefore, an error or difference does not occur between the indication value of the mechanical revolution indicator and the indication value of the electronic indicator which is different from the prior art where the signal of the incremental type is counted and displayed by a counter. Thus, there is no need to execute the readjusting work.

Since the present invention is constructed as mentioned above, according to the invention, it is possible to provide a convenient accurate revolution indicator for measuring distances, in which no error occurs between the indication values of the mechanical indicator and the electronic indicator and there is no need to execute any adjustment at the time of restarting of the ram or the like after the operation of the ram or like was stopped.

The present invention is not limited to the above embodiment. For instance, the counter of the invention is not limited only to the press but can be also applied to a lathe, a milling cutter, or the like. Further, the present invention is not limited to the machine tool but can be also widely applied to a running distance measuring instrument of vehicles, a height measuring instrument, and other measuring instruments. The invention includes all of the modifications and variations of the invention which can be easily thought from the above description by those skilled in the art in accordance with the applied objects.

What is claimed is:

1. A revolution indicator for measuring distances comprising:

a plurality of numeral indicating wheels, each wheel having an peripheral circumferential surface having numerals 0 to 9 thereon at predetermined circumferential positions, each of said wheels being provided with a magnetic code ring defining a cylindrical member disposed over an outer circumferential periphery of said circumferential surface, magnetic codes indicative of numeral values 0 to 9 being disposed on said magnetic code ring;

a common axis for rotatably supporting said wheels;

input means for transmitting an input rotation to one of the numeral indicating wheels;

a plurality of rotation transmitting means for transmitting one rotation of a wheel to an adjacent wheel in the form of a 1/10 rotation, each rotation transmitting means located between two adjacent wheels;

a casing which has a window for allowing numerical values shown by the numeral indicating wheels to be seen therethrough and which has therein at least said plurality of numeral indicating wheels, said common axis, and said plurality of rotation transmitting means;

a code reading means for reading the magnetic codes disposed on the magnetic code ring, provided within said casing radially adjacent to said peripheral circumferential surface of said wheel such that said code reading means reads a magnetic code corresponding to a numerical value seen through said window;

an electronic code indicator provided on the outside of the casing, and means for transmitting an output of the code reading means to said electronic code indicator.

2. A revolution indicator for measuring distances according to claim 1, wherein the magnetic codes recorded on the magnetic code ring are binary coded decimal codes.

3. A revolution indicator for measuring distances according to claim 1, wherein said indicator is applied to indicate a moving distance or a position of a table of a machine tool.

4. A revolution indicator for measuring distances according to claim 1, wherein said indicator is applied to indicate a moving distance or position of a ram of a press.

5. A position indicator for displaying a position of a mechanical apparatus comprising:

at least two numerical indicating wheels each having indicia on a circumferential peripheral surface thereof, each said wheel having a magnetic code ring defining a cylindrical member disposed over said circumferential peripheral surface thereof, a magnetic code being disposed on said magnetic code ring, said indicia and said magnetic code corresponding to a rotational position of said wheel;

a common axis for rotatably supporting each said wheel, said wheels being arranged from a lower order to a higher order numerical indicating wheel on said common axis;

input means for transmitting said position of said mechanical apparatus in a rotational manner to one said wheel;

a rotational transmitting means, located between adjacent wheels, for transforming a rotation of said lower order numerical indicating wheel in the form of a predetermined fraction of said rotation and transmitting said fraction of said rotation to said higher order numerical indicating wheel adjacent to said lower numerical indicating wheel;

a casing which includes a window for allowing said indicia to be viewed from outside said casing;

a code reading means for reading said magnetic code disposed outside of and radially adjacent to said circumferential peripheral surface of each said numerical indicating wheel such that said code reading means reads a magnetic code corresponding to indicia viewed from outside said casing; and an electronic code indicating means for providing a visual translation of said magnetic code read by said code reading means, said visual translation being equivalent to said indicia viewed from outside said casing.

6. The position indicator of claim 5, wherein said indicia is at least one number.

7. The position indicator of claim 5, wherein said position is a linear position.

8. The position indicator of claim 5, wherein said predetermined fraction is 1/10.

9. The position indicator of claim 5, wherein each said magnetic code coincides with the same rotational position of said wheel as said indicia.

10. The position indicator of claim 5, wherein said magnetic codes are binary coded decimal codes.

11. The position indicator of claim 5, wherein said position indicator indicates a measurement relevant to a location on a machine tool.

12. The position indicator of claim 5, wherein said position indicator indicates a position of a machine tool.

13. The position indicator of claim 5, wherein said position indicator is applied to indicate at least either a moving distance and a position of a ram press.

14. The position indicator of claim 5, wherein said electronic code indicating means is remotely located outside of said casing.

* * * * *